US006715654B2

(12) United States Patent
Sugihara et al.

(10) Patent No.: US 6,715,654 B2
(45) Date of Patent: Apr. 6, 2004

(54) STAPLE CARTRIDGE SYSTEM

(75) Inventors: Shinpei Sugihara, Tokyo (JP); Shinya Abe, Tokyo (JP); Hiroshi Udagawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 119 days.

(21) Appl. No.: 10/093,635

(22) Filed: Mar. 11, 2002

(65) Prior Publication Data

US 2002/0125293 A1 Sep. 12, 2002

(30) Foreign Application Priority Data

Mar. 12, 2001 (JP) ..... P2001-069400

(51) Int. Cl.[7] ..... B25C 5/16; B27F 7/38

(52) U.S. Cl. ..... 227/2; 227/109; 227/131; 227/136

(58) Field of Search ..... 227/2, 4, 109, 227/120, 136, 131, 156

(56) References Cited

U.S. PATENT DOCUMENTS 5,269,503 A * 12/1993 Hiroi et al. ..... 227/2
5,518,164 A * 5/1996 Hooven ..... 227/19
5,535,937 A * 7/1996 Boiarski et al. ..... 227/19
5,573,233 A * 11/1996 Hirai et al. ..... 270/58.08
6,050,471 A * 4/2000 Yagi ..... 227/131
6,371,352 B1 * 4/2002 Mochizuki ..... 227/131
6,474,633 B1 * 11/2002 Hirai ..... 227/120

FOREIGN PATENT DOCUMENTS

| | | |
|---|---|---|
| EP | 1 090 778 | 11/2001 |
| JP | 2001-171898 | 6/2001 |

* cited by examiner

*Primary Examiner*—Scott A. Smith
(74) *Attorney, Agent, or Firm*—Morgan, Lewis & Bockius LLP

(57) ABSTRACT

Outer shape dimensions of a staple cartridge for binding 100 sheets and a staple cartridge for binding 50 sheets are made the same. Staple detecting holes are provided at bottom faces of both of them, and a cartridge identifying hole for identifying a type of a cartridge is formed at one of them. A cartridge identifying sensor and a staple detecting sensor are provided at the inside of an electric stapler. Charge of the staple cartridge, determination of a cartridge type and presence or absence of a staple at the inside of the staple cartridge are detected by signals of the sensors.

6 Claims, 6 Drawing Sheets

STAPLE CARTRIDGE SYSTEM

BACKGROUND OF THE INVENTION

1. Field of the Invention

The present invention relates to a staple cartridge system, particularly to a staple cartridge system constituted to be able to use a plurality of types of staples by one type of an electric stapler.

2. Description of the Related Art

There is widely and generally used a copier built with an electric stapler and constituted to be able to continuously carry out a copying step and a binding step. An electric stapler built in a copier is of a type of using a staple cartridge containing to stack staple sheets adhered in parallel with linear staples for containing a large amount of staples. A document is bound by the staple of which the linear staple is formed into a gate-like shape by a forming mechanism.

Normally, a copier of this kind is built with an electric stapler for binding a booklet (up to about 50 sheets) and an electric stapler for binding a larger volume of a booklet (up to about 100 sheets). This is because there is a case in which when, for example, a booklet of about 10 sheets is bound by a long staple for binding 100 sheets, legs of a staple folded to bend are prolonged. This is not only the outlook is poor but also in a binding process, points of the two legs of the staple are abutted to each other and projected from a surface of the booklet by penetrating the sheets again. Accordingly, a control portion of the copier is constituted to select to drive an electric stapler for 50 sheets and an electric stapler for 100 sheets in accordance with a number of sheets for copying to prevent such a drawback from being brought about.

A linear length differs between a staple for binding 50 sheets and a staple for binding 100 sheets and therefore, conventionally, dimensions of respective staple cartridges differ from each other. Accordingly, electric stapler main bodies are respectively used exclusively from each other and are not compatible to each other. However, when outer shapes of the staple cartridges are made the same and either of the staple cartridges can be used by one type of an electric stapler, in the case of building with a plurality of pieces of electric staplers, the cost can be reduced by common formation of the electric stapler main body. However, in that case, in order that a copier uses different staples in accordance with a number of sheets for binding as described above, it is necessary that the copier can determine the type of the staple at the inside of the staple cartridge.

SUMMARY OF THE INVENTION

Hence, there poses a technical problem to be resolved in order to enable to use a plurality of types of staples by one type of an electric stapler and provide a staple cartridge by which a copier can determine a type of a staple. This is an object of the invention to resolve the above-described problem.

The invention has been proposed to achieve the above-described object and there is provided a staple cartridge system constituted by a plural of types of staple cartridges respectively having different inner dimensions in correspondence with plural types of staple sheets having different linear lengths and having the same shape and the same outer configuration dimension. The staple cartridge system is formed such that a bottom face of the staple cartridge is provided with a staple detecting hole for detecting presence or absence of the staple sheet and charge of the cartridge, and the type of the cartridge and presence or absence of the staple can be determined by presence or absence of a cartridge identifying hole via a sensor provided to an electric stapler.

DETAILED DESCRIPTION OF THE PREFERRED EMBODIMENTS

Figure 1:
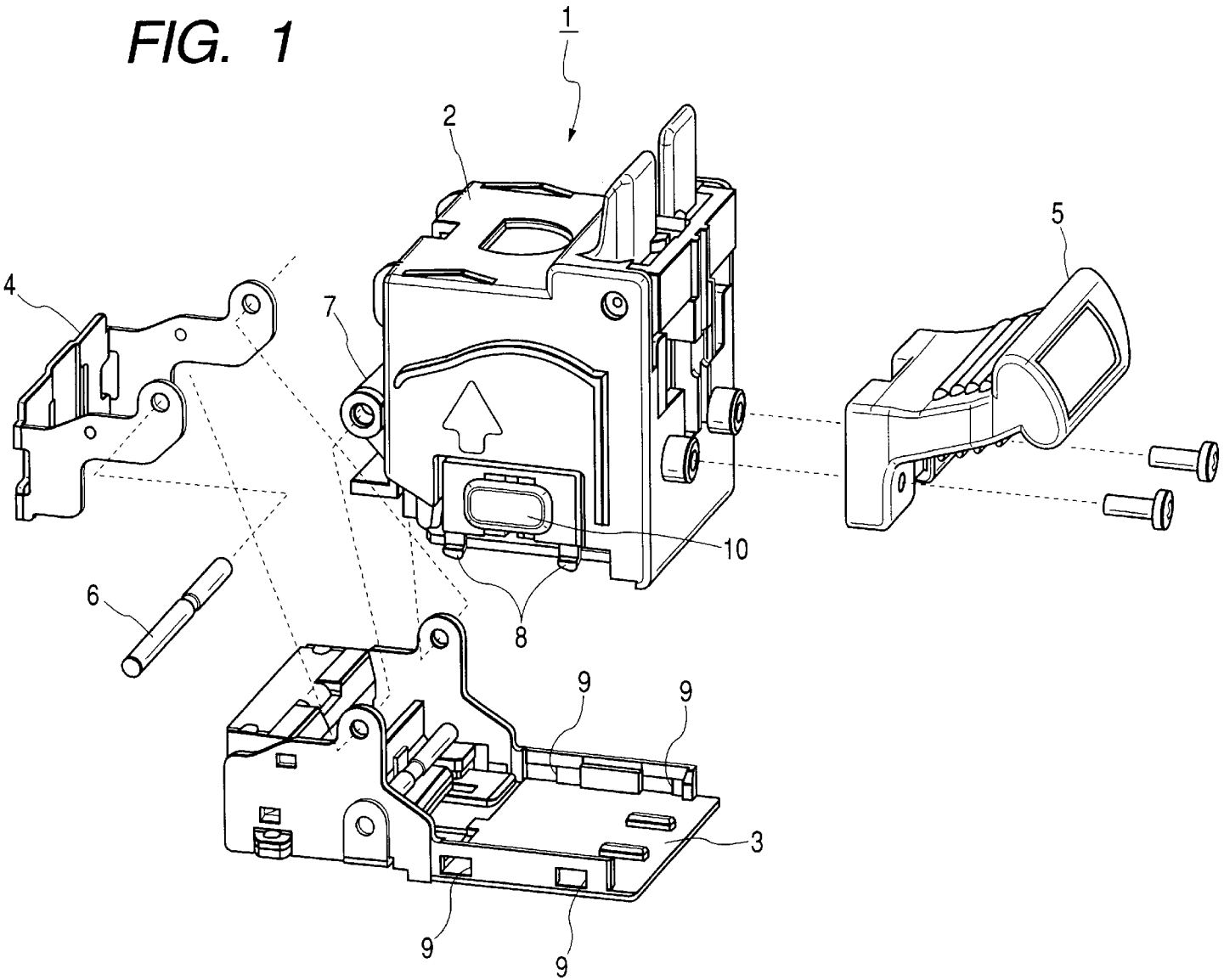
FIG. 1 shows an embodiment of the invention and is a view of assembling a staple cartridge for binding 100 sheets.

A detailed explanation will be given of an embodiment of the invention in reference to the drawings as follows. FIG. 1 is a view for assembling a staple cartridge 1, numeral 2 designates a staple holder, numeral 3 designates a cover assembly, numeral 4 designates a face plate and numeral 5 designates a handle. The cover assembly 3 and the face plate 4 are attached to a bearing 7 at a front portion (left in the drawing) of the staple holder 2 via a shaft 6, and the handle 5 is screwed to a rear face of the staple holder 2.

Claws 8 are formed at lower end portions of two side faces of the staple holder 2. When holes 9 of two side faces of the cover assembly 3 are engaged with the claws 8, the cover assembly 3 is fixed to the staple holder 2, and a lower face opening of a staple chamber at the inside of the staple holder 2 is closed. Although not illustrated, the shaft 6 is mounted with a torsional coil spring and when tub portions 10, which is at the two side faces of staple holder 2 made of a resin, are depressed, engagement between the claws 8 and the holes 9 of the cover assembly 3 is released and the cover assembly 3 is pivoted in the clockwise direction in the drawing by spring force of the torsional coil spring to thereby open the staple chamber at the inside of the staple holder 2.

Figure 2:
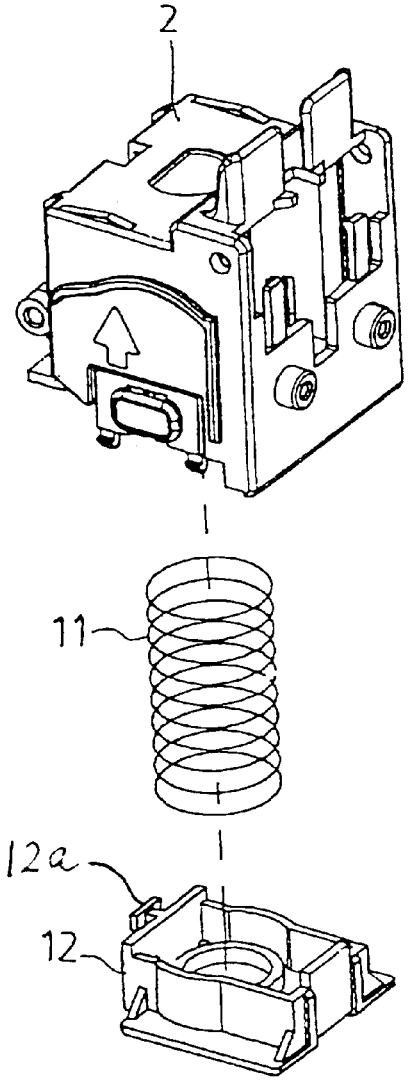
FIG. 2 is a view of assembling a staple holder in the staple cartridge of FIG. 1.

FIG. 2 shows the staple holder 2 and a compressive coil spring 11 and a press plate 12 are inserted from the lower face opening into the staple chamber. At this occasion, a projected portion 12*a* of a front face of the press plate 12 is engaged with a groove (not shown) directed in an up and down direction and formed at a front face of the staple holder 2, and the press plate 12 is assembled slidably in the up and down direction. In charging staple sheets to the staple holder 2, the cover assembly 3 shown in FIG. 1 is opened, the staple sheets are inserted into a cartridge chamber while pressing the press plate 12 by the staple sheets in a stacked state from a lower side. Then, the cover assembly 3 is closed. There are the staple holder 2 having a transverse width in the staple chamber in correspondence with a staple sheet for binding 100 sheets and the staple holder 2 having a transverse width in correspondence with the staple sheets for binding 50 sheets. Both of them are provided with an outer configuration having the same shape and the same dimension.

Figure 3:
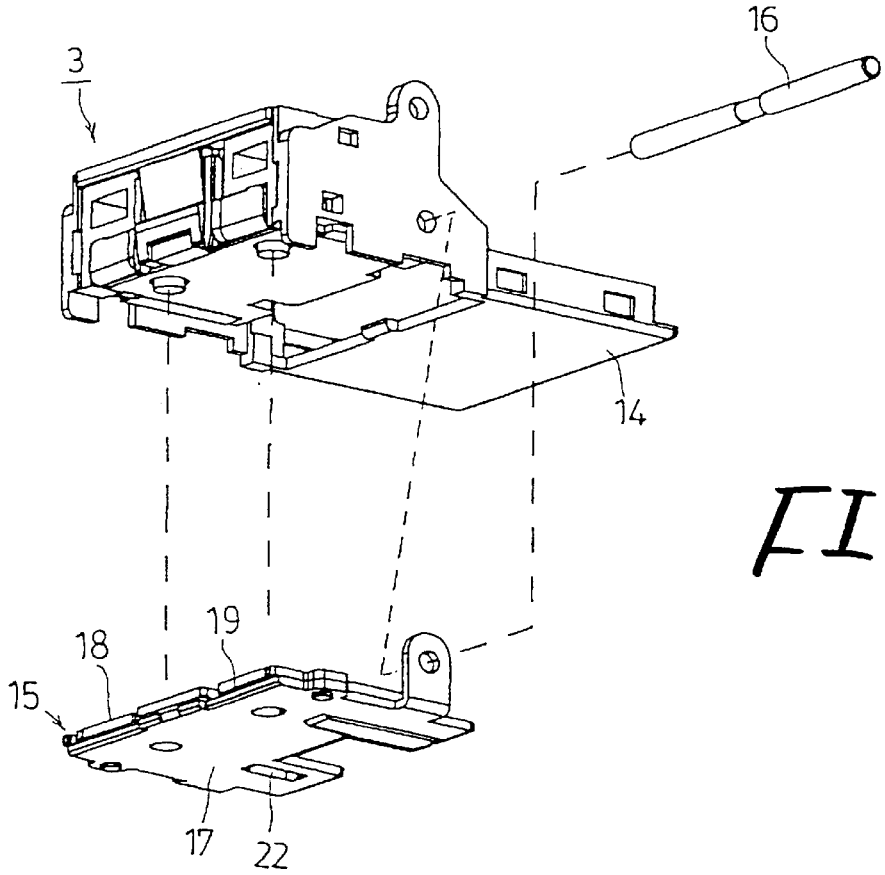
FIG. 3 is a view of assembling a cover assembly in the staple cartridge of FIG. 1.

FIG. 3 shows the cover assembly 3. A staple guide unite 15 made of a metal is fixed to a bottom face of a front portion of a cover plate 14 by a shaft 16. The staple guide unit 15 is constituted by a two-layered structure of a base plate 17 and a top plate 18, and a staple sheet passes in a slot 19 between the base plate 17 and the top plate 18.

Figure 4:
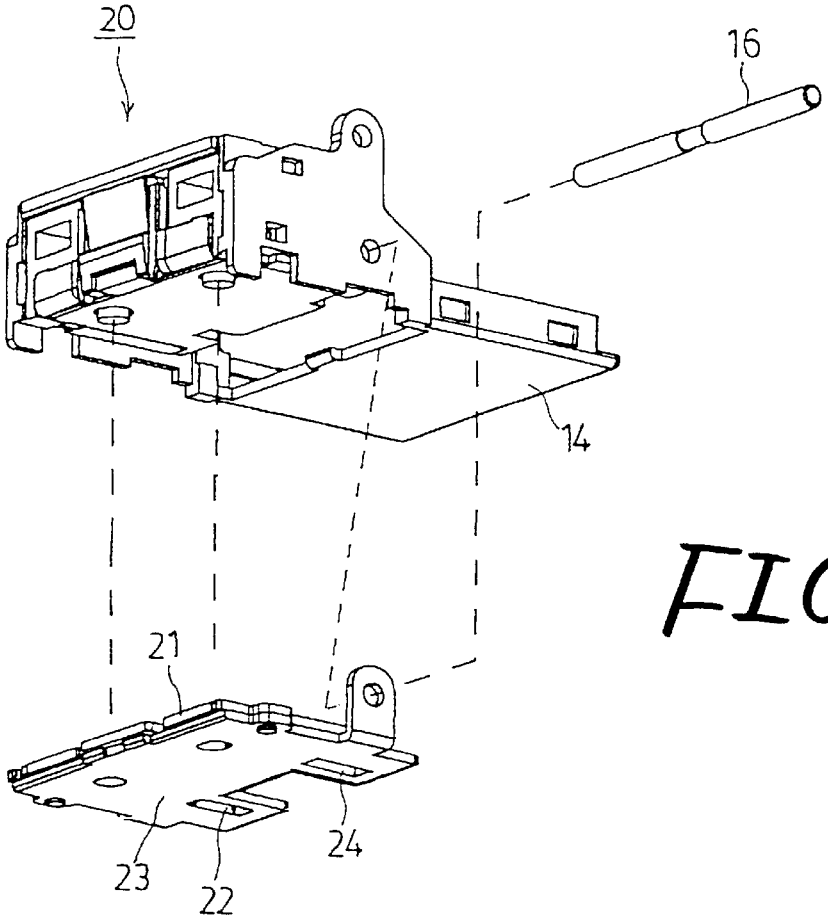
FIG. 4 is a view of assembling a cover assembly in a staple cartridge for binding 50 sheets.

As the staple guide unit, there are the staple guide unit 15 for binding 100 sheets shown in the drawing and a staple guide unit 20 for binding 50 sheets shown in FIG. 4, widths of slots 19 and 21 are formed respectively in conformity with lengths of the staples. A staple detecting hole 22 is formed at the base plate 17 of the staple guide unit 15 for binding 100 sheets, and a cartridge identifying hole 24 is formed at a base plate 23 of the staple guide unit 20 for binding 50 sheets in addition to the staple detecting hole 22. When staple sheets are charged to the staple cartridge for binding 50 sheets, the surface of the staple sheet is seen in two pieces of the holes 22 and 24.

Figure 5:
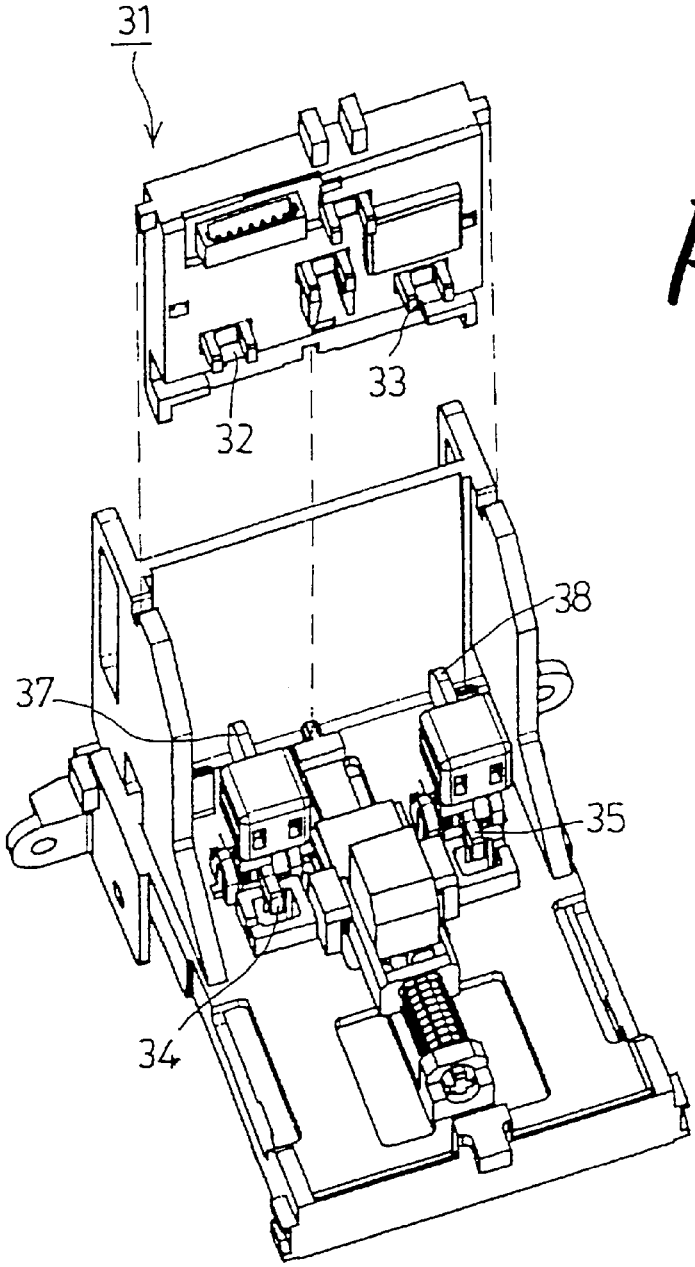
FIG. 5 is a view of assembling a cartridge detecting apparatus in an electric stapler.
Figure 6:
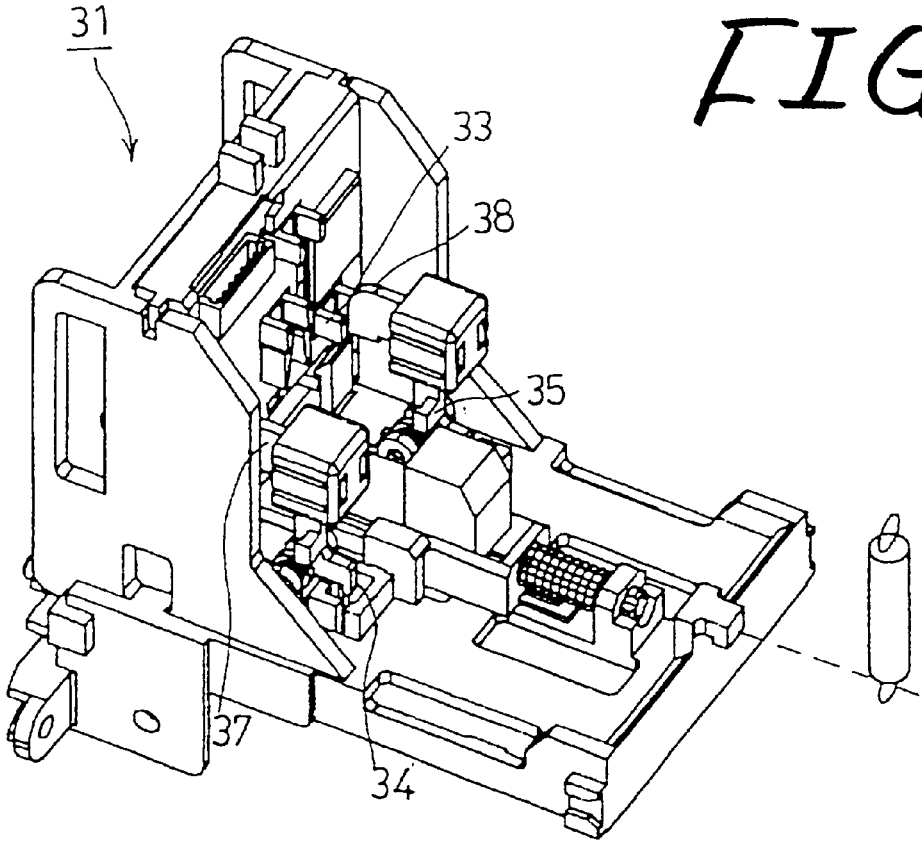
FIG. 6 is a perspective view of the cartridge detecting apparatus in the electric stapler.

FIG. 5 and FIG. 6 show a cartridge detecting apparatus 31 mounted to the inside of the electric stapler and is provided with two pieces of photointerrupters 32 and 33, a staple detecting lever 34 and a cartridge identifying lever 35. The lower end portions of two pieces of the levers 34 and 35 are projected to the lower side through holes of a base plate 36 and plates 37 and 38 are projected from upper ends of the levers 34 and 35 to a front side. The plates 37 and 38 are attached to upper end portions of the levers 34 and 35 via compression springs and are formed to be more or less pressed to sides of the levers 34 and 35 when the plates 37 and 38 are brought into elastic contact with a front wall face.

The staple cartridge 1 is mounted to the electric stapler in a state in which an attitude thereof shown in FIG. 1 is made upside down, and a bottom face of the base plate 17 of the staple cartridge 1 is opposed to a bottom face of the cartridge detecting apparatus 31. At this occasion, a lower end of the cartridge identifying lever 35 is disposed at a position in correspondence with the cartridge identifying hole 24, and a lower end of the staple detecting lever 34 is disposed at a position in correspondence with the staple detecting hole 22.

Next, an explanation will be given of operation of the cartridge detecting apparatus 31. When the staple cartridge is not charged, the lower ends of the staple detecting lever 34 and the cartridge identifying lever 35 are disposed at initial positions projected to the lower side. At this occasion, the plates 37 and 38 attached to the front ends of two pieces of the levers 34 and 35 are left from intervals of the photointerrupters 32 and 33, and an output signal of the cartridge identifying photointerrupter 33 is "1" and an output signal of the staple detecting photointerrupter 32 is "1".

When the staple cartridge 1 for binding 100 sheets, which is formed with the staple detecting hole 22 at the base plate 17, is charged to the electric stapler, the lower end of the cartridge identifying lever 35 is pushed up by the base plate 17. Then, the staple detecting lever 34 is pushed up by the staple sheets, and the plates 37 and 38 at the front ends of two pieces of the levers 34 and 35 are brought into the intervals of the photointerrupters 32 and 33. Thereby, the output signal of the cartridge identifying photointerrupter 33 becomes "0", and the output signal of the staple detecting photointerrupter 32 becomes "0". Accordingly, the control portion of the copier detects that the staple cartridge 1 for binding 100 sheets is charged by a combination of "0", "0".

When the staple cartridge for binding 50 sheets, which is formed with the staple detecting hole 22 and the cartridge identifying hole 24 at the base plate 23, is charged to the electric stapler, the lower end of the cartridge identifying lever 35 is brought into the cartridge identifying hole 24. Then, the output signal of the cartridge identifying photointerrupter 33 remains unchanged from "1" since the initial state is constituted. Meanwhile, the staple detecting lever 34 is pushed up by the staple sheets. Accordingly, the plate 37 at the front end is brought into the interval of the staple detecting photointerrupter 32, and the output signal becomes "0". Accordingly, the control portion of the copier detects that the staple cartridge for binding 50 sheets is charged by a combination of "1", "0".

Further, in either of the staple cartridge for binding 100 sheets and the staple cartridge for binding 50 sheets, when a tail of a final staple sheet passes through the staple detecting hole 22, the lower end of the staple detecting lever 34 is brought into the staple holder 2 and returns to the initial position. Accordingly, the plate 37 comes out from the interval of the staple detecting photointerrupter 32 and the output signal becomes "1". Thereby, the control portion of the copier detects that the staple sheets have been used up and displays a staple sheet replenishing message at a display portion.

Further, the invention is not limited to the above-described embodiment but can variously be modified within the technical range of the invention and the invention naturally covers the modified constitution.

As explained above, according to the staple cartridge system of the invention, the outer shape dimension of the cartridge is the same regardless of the types of the staples. Accordingly, a plurality of types of staples can be used by one type of the electric stapler, and the type of the staple cartridge can be determined by presence or absence of the cartridge identifying hole. Further, charge of the cartridge as well as presence or absence of the staple can be detected by the staple detecting hole and therefore, the cost can be reduced by the common formation of the main body of the electric stapler when a plurality of the electric staplers are built in a copier or the like.

What is claimed is:

1. A staple cartridge system comprising:

an electric stapler;

a cartridge detecting apparatus provided to said electric stapler; and a plurality of types of staple cartridges respectively including a staple detecting hole for detecting at least one of presence of staple sheet and charge of said staple cartridge, said staple cartridges having the same shape and the same outer configuration dimension and respectively having different inner dimensions in correspondence with a plurality of types of the staple sheets having different linear lengths, wherein at lease one of said staple cartridges further includes a cartridge identifying hole for identifying the type of said staple cartridge, and wherein the presence of the staple sheet, the charge of said staple cartridge and the type of said staple cartridge is determined by said cartridge detecting apparatus.

2. The staple cartridge system according to claim 1, wherein said cartridge detecting apparatus includes a sensor.

3. The staple cartridge system according to claim 1, wherein said cartridge detecting apparatus includes:

a staple detecting lever including a first plate;

a cartridge identifying lever including a second plate; and a control portion for determining at least one of the presence of the staple sheet, the charge of said staple cartridge and the type of said staple cartridge, wherein said first plate of said staple detecting lever changes a first output sent to said control portion when said staple detecting lever is pushed up by the staple sheet, and wherein said second plate of said cartridge identifying lever changes a second output sent to said control portion when said staple cartridge identifying lever is pushed up by a portion of said staple cartridge.

4. The staple cartridge system according to claim 3, wherein said cartridge detecting apparatus further includes:

a first photointerrupter;

a second photointerrupter, wherein the first output is sent from said first photointerrupter to said control portion, and wherein the second output is sent from said second photointerrupter to said control portion.

5. The staple cartridge system according to claim 1, wherein said staple detecting hole and said cartridge identifying hole are provided to a bottom face of said staple cartridge.

6. The staple cartridge system according to claim 1, further comprising:

a display portion for displaying a message that the staple sheets are used up.

* * * * *